United States Patent [19]

Sobieniak

[11] Patent Number: 4,469,578

[45] Date of Patent: Sep. 4, 1984

[54] HYDROGEN VENT ASSEMBLY

[76] Inventor: Mathew G. Sobieniak, 76 Onondaga St., Lewiston, N.Y. 14092

[21] Appl. No.: 521,876

[22] Filed: Aug. 10, 1983

[51] Int. Cl.[3] ..... C25B 9/00

[52] U.S. Cl. ..... 204/279; 204/258

[58] Field of Search ..... 204/247, 256, 258, 266, 204/270, 278, 279, 98, 128; 425/812; 137/247.41, 247.45; 222/188

[56] References Cited

U.S. PATENT DOCUMENTS

| | | | |
|---|---|---|---|
| 1,086,804 | 2/1914 | Burdett | 204/258 |
| 1,221,206 | 4/1917 | Mueller | 204/258 |
| 1,273,357 | 7/1918 | Gougnard | 204/256 |
| 1,452,589 | 4/1923 | Brading | 204/258 |
| 1,963,959 | 6/1934 | Enzor | 204/258 |
| 3,944,437 | 3/1976 | Auerbach | 429/82 |
| 4,370,208 | 1/1983 | Iijima et al. | 204/98 |

*Primary Examiner*—Howard S. Williams

*Assistant Examiner*—T. L. Williams

*Attorney, Agent, or Firm*—J. F. Tao; W. G. Gosz

[57] ABSTRACT

An improved three-piece polymeric hydrogen vent assembly for use on chlor-alkali diaphragm cells comprises an elongated tube containing a standpipe and an inverted cup which separates the standpipe from the tube. The cup has a plurality of openings in its base portion and a manometer fitting in its top. The entire three-piece assembly is fabricated from a polymeric material, preferably polypropylene, and can be conveniently molded in a one-piece unit. Each individual component of the assembly can be separately cut from the single molded unit and assembled.

The hydrogen vent assembly is primarily useful as a replacement for existing steel components and has the advantages of being less corrosive than carbon steel, easier to install, and safer in operation since it has a reduced risk of overflow during cell start-up.

7 Claims, 2 Drawing Figures

HYDROGEN VENT ASSEMBLY

BACKGROUND OF THE INVENTION

The present invention is directed to an improved hydrogen vent assembly for use on chlor-alkali diaphragm cells. The entire assembly is fabricated from a polymeric material, preferably in one-piece blow molding operation. The assembly can be used on either existing cells as a replacement part or on new cells.

Conventional diaphragm cells used in the chlor-alkali industry generate chlorine and sodium hydroxide as principle electrochemical products from the electrolysis of brine. Such cells contain a plurality of anode and cathode chambers where the chlorine and sodium hydroxide, respectively, are produced. A small but none the less significant amount of hydrogen is also formed in the cathode chamber. The hydrogen gas is usually collected by means of overhead piping and stored in a container for disposal. During the operation of the cell, hydrogen can build up within the cathode chamber, and if such build-up is not controlled, it can damage internal cell components or even lead to explosions within the cell. As a safety feature, many commercial cells now in use, such as the H-4 cell manufactured by the Occidental Chemical Corporation, are equipped with a device for venting excess hydrogen from the cell in the event that the hydrogen pressure exceeds a designated level. Conventional hydrogen vent assemblies are fabricated from a complex network of iron or steel piping and are attached to the upper external surface of the cell. One end of the assembly communicates with the interior of the cell through an opening provided in the upper external portion of the cell. This opening collects hydrogen from the individual cathode compartments of the cell. The assembly is provided with a cup for containing water as a pressure regulator, and a manometer for measuring pressure. If the hydrogen pressure in the cell exceeds the level of water in the cup, the hydrogen gas bubbles through the vent and is safely discharged into the atmosphere.

Although the conventional hydrogen vent assembly is fabricated largely from standard metal components, it suffers from a number of serious drawbacks. Since the assembly is fabricated entirely of iron or steel, it tends to rust prematurely and must therefore be frequently replaced. Once installed, the assembly cannot be easily repaired or replaced which creates maintenance and reinstallation problems. In addition, the conventional design provides for a relatively low seal level relative to the cell which increases the risk of overflow of corrosive catholyte liquor through the vent during cell start-up. This can pose a significant safety hazard since the cells are periodically shut down and restarted under normal operation conditions.

It is therefore the principle object of the present invention to provide an improved hydrogen vent assembly which successfully overcomes the numerous disadvantages associated with the vent assemblies of the prior art.

SUMMARY OF THE INVENTION

In accordance with the present invention, an improved hydrogen vent assembly is provided for use on chlor-alkali diaphragm cells. The assembly is fabricated entirely from polymeric materials such as polyethylene, polypropylene, PVC, CPVC, or ABS. The assembly can be advantageously manufactured as a one-piece blow molded unit and the individual elements of the assembly cut from the single unit and subsequently assembled.

The vent assembly of the present invention comprises three components. The primary component is an elongated tube which has a threaded lower section for engaging the hydrogen outlet pipe of the cell, and an enlarged upper section which is adapted to contain water, or any suitable liquid medium. A standpipe having the same approximate cross-section as the lower section of the tube is fitted within the tube to form a fluid-tight seal with the tube at its point of engagement. An inverted cup is placed over the standpipe and within the tube to cover the standpipe. This cup has a plurality of openings in its lower base portion to permit the release of hydrogen gas. The cup is also equipped with a fitting in its top portion for a manometer.

The hydrogen vent assembly of the present invention does not have the corrosion problems of carbon steel, is durable and easily assembled. This assembly also has a significant safety advantage since it has an elevated liquid level which reduces the risk of overflow of corrosive liquid during start-up of the cell.

DESCRIPTION OF THE PREFERRED EMBODIMENTS

Figure 1:
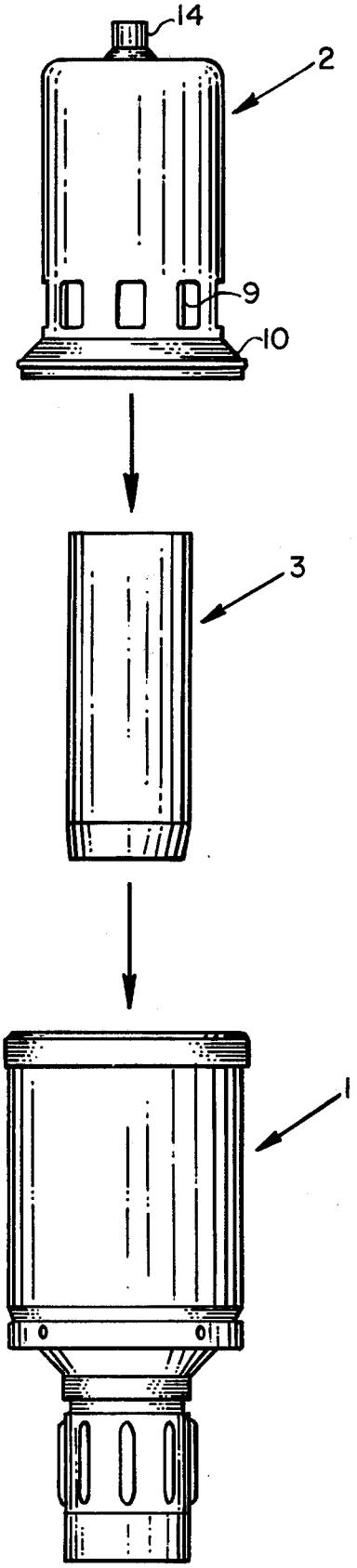
FIG. 1 is an exploded drawing showing each of the individual components of the hydrogen vent and their assembled relationships.

The improved hydrogen vent assembly of the present invention comprises three components, namely, an elongated tube, a standpipe and an inverted cup. The elongated tube has an enlarged upper section which is tapered to a lower section of a somewhat smaller cross-sectional area. The end of the lower section has external threads for engaging the hydrogen outlet pipe of the diaphragm cell. This outlet pipe protrudes from the upper extenal section of the cell. The upper enlarged portion of the tube is adapted to contain a fluid medium such as water or cell liquid. The tube can have any desired cross-section, although for convenience, a circular cross-section is preferred. It is to be understood, however, that the expression "tube" as used herein is not limited to an object having a circular cross-section.

A standpipe is emplaced within the elongated tube. The standpipe preferably has a uniform cross-section of approximately the same dimensions as the lower portion of the elongated tube. The lower end of the standpipe is sealed to the lower inner surface of the tube to form a fluid-tight seal. Since both the tube and standpipe are fabricated from a polymer, such sealing can be suitably accomplished by heating the polymer to a temperature above its fusion point.

The overall length of the standpipe will depend on several factors. The upper end of this component must not protrude beyond the upper end of the tube. However, the standpipe must also be of sufficient length to maintain an appropriate back-pressure to prevent premature release of hydrogen gas from the vent except in emergency situations as intended.

The third component of the hydrogen vent assembly is an inverted cup which is emplaced with the tube covering the standpipe. The cup has a cross-section intermediate between the cross-section of the standpipe and the enlarged upper section of the tube, and is adapted at its base portion to sealingly engage the lower inner surface of the tube. Such engagement need not be fluid-tight and these components can be press-fitted or snap-fitted.

When emplaced within the tube, the cup forms two annular regions between the standpipe and the cylinder, an inner annular region and an outer annular region. Fluid communication between both regions, said fluid being in the form of a liquid or gas, is provided by suitable peripheral openings in the cup. The positioning of the openings relative to the height of the cup will depend on the back-pressure which is maintained in the vent assembly. Preferably, the openings are located in the lower base portion of the cup. A manometer can be inserted in the fitting and secured in place by means of a stopper or other conventional sealing element.

The entire hydrogen vent assembly is formed from a suitable polymeric material. Examplary of such materials are polypropylene, polyethylene, PVC, CPVC, or ABS. Polypropylene is generally preferred due to its low cost and high melting point. Although each of the individual components of the hydrogen vent can be fabricated separately, it is preferred, due to low cost and convenience, to form the entire assembly as a one-piece blow-molded unit. The individual components can then be cut apart and assembled.

The invention will now be more particulaly described by reference to the accompanying drawings. All three hydrogen vent assembly components illustrated in the drawings have circular cross-sections which is the preferred configuration.

FIG. 1 is an exploded drawing illustrating individual components of the hydrogen vent assembly and their respective relationships. As depicted in the drawing, elongated tube 1 has an enlarged upper section and a constricted lower section. The lower section has external threads for engaging the hydrogen outlet pipe of the cell 5. A standpipe 3 of approximate uniform cross-section is adapted to be fitted within the tube, engaging the lower inner surface thereof. An inverted cup 2 having peripheral openings 9 in the lower portion thereof is adapted to be emplaced within the tube covering the standpipe The base portion of the cup is in the form of a skirt 10 and also engages the lower inner surface of the tube above the engagement point of the standpipe. The cup has an opening 14 in the top portion thereof which serves as a fitting for a monometer (not shown in FIG. 1).

Figure 2:
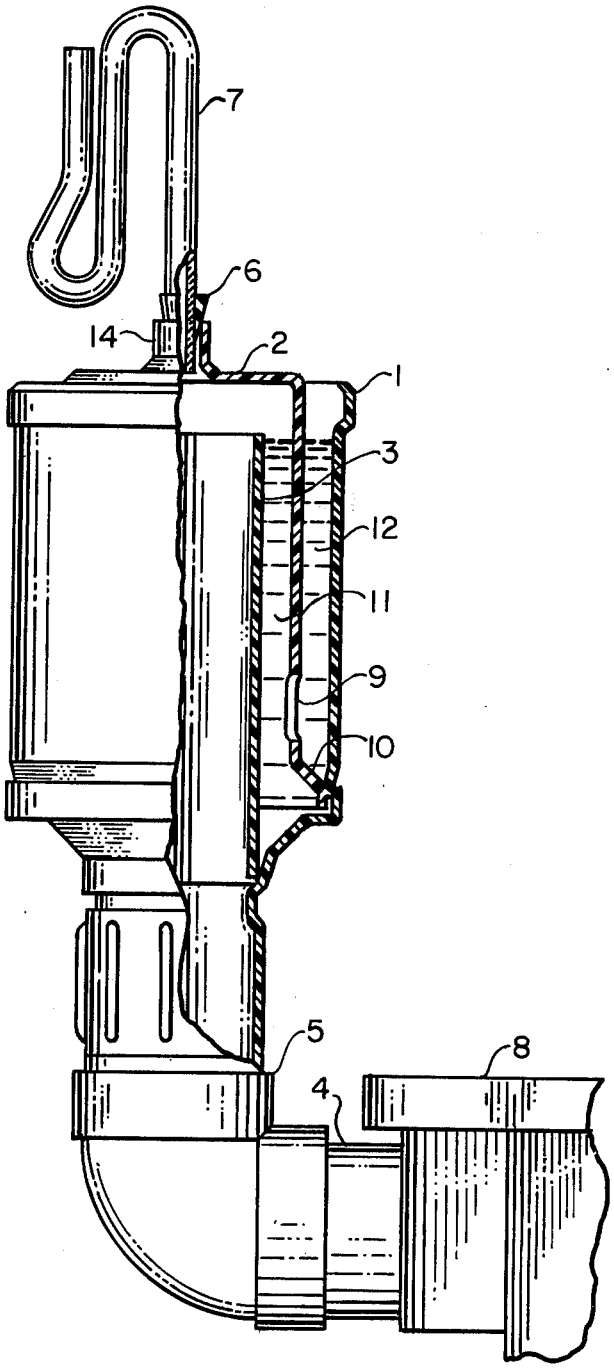
FIG. 2 is a side, partial cross-sectional view illustrating the complete hydrogen vent assembly and showing its attachment to a diaphragm cell.

FIG. 2 is a side partial sectional view of the assembled hydrogen vent. The lower end of tube 1 engages fitting 5 which also engages the hydrogen outlet pipe 4 of diaphragm cell 8. Standpipe 3 is sealed to the inner constricted surface of the tube at its lower end. Inverted cup 2 is emplaced within the tube and covers the standpipe. The cup has a flared base portion 10 which engages the lower inner surface of the enlarged upper section of the tube. Peripheral openings 9 are provided in the lower portion of the cup. The cup partitions the liquid space of the tube into an inner annular region 11 and an outer annular region 12. Both regions are adapted to contain a liquid medium as shown. Fluid communication between both regions in the form of liquid or gas is permitted by peripheral openings 9. The enclosed upper surface of the cup is provided with an outlet or fitting 14 which is adapted to contain a manometer 7. A seal 6 is provided to secure the manometer to the fitting.

In operation, the liquid level in both annular regions is sufficient to maintain the desired back-pressure which is needed to prevent the escape of hydrogen gas from the cell except during periods of pressure build-up when venting is necessary to prevent damage to internal cell components or explosions within the cell. The manometer also serves to indicate the relative pressure within the cell and is thus an additional safety feature.

Since the components of the hydrogen vent assembly are fabricated entirely of polymeric materials, the assembly is less corrosive than carbon steel components and requires little maintenance. The pressure differential can also be easily adjusted by varying the height of the standpipe as desired.

Although various embodiments of this invention have been shown and described in the specification, it is intended that the invention be liberally construed and not limited thereby. It is to be understood, therefore, that the appended claims are intended to cover all modifications and variations which are within the spirit and scope of the present invention.

What is claimed is:

1. An improved polymeric hydrogen vent assembly for use on chloralkali diaphragm cells, said assembly comprising:

(a) an elongated tube having an enlarged upper section with an open end and a lower section engaging the hydrogen outlet pipe of said cell, said tube being adapted to contain a liquid medium, (b) a standpipe emplaced within the tube, the lower end of said standpipe being sealed to the lower inner surface of said tube, the upper end of said standpipe being recessed below the open end of the tube, (c) an inverted cup emplaced within the tube enclosing the standpipe, said cup dividing the region between the standpipe and tube into an inner region and an outer region, the base of said cup being adapted to engage the lower inner surface of the tube, and the top of said cup having a manometer fitting communicating directly with the standpipe, said cup containing peripheral openings permitting fluid communication between the inner region and the outer region, and (d) a manometer sealed to the manometer fitting.

2. The hydrogen vent assembly of claim 1 wherein the liquid medium is water.

3. The hydrogen vent assembly of claim 1 which is formed from polypropylene.

4. The hydrogen vent assembly of claim 1 wherein the lower section of the elongated tube is provided with external threading for engaging the hydrogen outlet pipe.

5. The hydrogen vent assembly of claim 1 wherein the base of the inverted cup is flared.

6. The hydrogen vent assembly of claim 5 wherein the inverted cup is snap-fitted to the lower inner surface of the tube.

7. The hydrogen vent assembly of claim 1 wherein the tube, standpipe and cup have circular cross-sections.

* * * * *